US006262000B1

(12) United States Patent
Reeve et al.

(10) Patent No.: US 6,262,000 B1
(45) **Date of Patent: *Jul. 17, 2001**

(54) POWER TRANSMITTING FLUIDS OF IMPROVED ANTIWEAR PERFORMANCE

(75) Inventors: Philip Reeve, Wantage; Neville J Carter, Oxford; Robert Walter Humphrey, Newbury, all of (GB); Donald Glenn Young, Canford, NJ (US)

(73) Assignee: Exxon Chemical Patents Inc, Linden, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/043,135

(22) PCT Filed: Oct. 11, 1996

(86) PCT No.: PCT/EP96/04450

§ 371 Date: Mar. 9, 1998

§ 102(e) Date: Mar. 9, 1998

(87) PCT Pub. No.: WO97/14770

PCT Pub. Date: Apr. 24, 1997

(30) Foreign Application Priority Data

Oct. 18, 1995 (GB) ..... 9521352

(51) Int. Cl.[7] ..... C10M 135/04; C10M 137/08

(52) U.S. Cl. ..... 508/371; 508/436; 508/440; 508/567

(58) Field of Search ..... 508/371, 436, 508/569, 440

(56) References Cited

U.S. PATENT DOCUMENTS

| | | | | |
|---|---|---|---|---|
| 3,197,405 | * | 7/1965 | Le Seur | 508/349 |
| 5,500,140 | * | 3/1996 | Hughes | 508/224 |
| 5,750,477 | * | 5/1998 | Sumiejski et al. | 508/331 |

* cited by examiner

*Primary Examiner*—Margaret Medley
*Assistant Examiner*—Cephia D. Toomer

(57) ABSTRACT

The antiwear performance of power transmitting fluids, particularly continuously variable transmission fluids, is improved by incorporating an additive combination of amine phosphates, organic polysulfides, zinc salts of phosphorothioic acid esters and optionally a friction modifier.

3 Claims, No Drawings

POWER TRANSMITTING FLUIDS OF IMPROVED ANTIWEAR PERFORMANCE

This application is a 371 of PCT/EP96/04450 filed Oct. 11, 1996.

This invention relates to a composition and a method of improving the antiwear performance of power transmitting fluids, particularly continuously variable transmissions (CVT's). This is accomplished in a CVT fluid compatible with conventional friction modifiers.

The continuing search for methods to improve overall vehicle fuel economy has identified power transmitting units as a source of energy loss. For example, the torque converter, used between the engine and automatic transmission, since it is a fluid coupling, is not 100% efficient as compared to a solid disk type clutch.

One method of improving overall vehicle fuel economy is by the use of CVT's. A CVT is a power transmitting device which operates by transferring power between driving and driven pulley-like conical sheaves via a steel belt. The conical sheaves are actuated in manner which allows continuous engagement of the power drive system while the vehicle is traveling in a particular direction, i.e. either forward or reverse. The CVT is very effective at capturing lost energy and is capable of enhancing vehicular fuel economy upwards between 10–20 percent above vehicles with conventional gear driven power transmitting devices.

We have found additive combinations which meet the very exacting antiwear requirements of CVT's and are compatible with conventional friction modifiers.

SUMMARY OF THE INVENTION

This invention relates to a composition and method of improving the antiwear performance of a power transmitting fluid comprising:

(1) a major portion of a lubricating oil; and (2) an antiwear improving effective amount of an additive combination comprising:
- (a) an amine phosphate;
- (b) an organic polysulfide;
- (c) a zinc salt of a phosphorothioic acid ester; and
- (d) optionally, a friction modifier.

DETAILED DESCRIPTION OF THE INVENTION

We have found that fluids containing the additive combinations of this invention, provide excellent antiwear, i.e., load carrying/extreme pressure characteristics. The antiwear characteristics of these fluids are not adversely impacted by optionally incorporating one or more friction modifiers.

While the invention is demonstrated for a particular power transmitting fluid, i.e., a CVT, it is contemplated that the antiwear and friction benefits of this invention are equally applicable to other types of power transmitting fluids such as automatic transmission fluids, gear oils, hydraulic fluids, heavy duty hydraulic fluids, industrial oils, power steering fluids, pump oils, tractor fluids, universal tractor fluids, and the like. These power transmitting fluids can be formulated with a variety of performance additives and in a variety of base oils.

Lubricating Oils

Lubricating oils useful in this invention are derived from natural lubricating oils, synthetic lubricating oils, and mixtures thereof. In general, both the natural and synthetic lubricating oil will each have a kinematic viscosity ranging from about 1 to about 40 $mm^2/s$ (cSt) at 100° C., although typical applications will require each oil to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly (1-hexenes), poly (1-octenes), poly-(1-decenes), etc., and mixtures thereof]; alkylbenzenes [e.g., dodecyl-benzenes, tetradecylbenzenes, dinonyl-benzenes, di(2-ethylhexyl) benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of $\alpha$-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000–1500) and mono- and poly-carboxylic esters thereof (e.g., the acetic aid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl isothalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid ), polymeric tetra-hydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

When the lubricating oil is a mixture of natural and synthetic lubricating oils (i.e., partially synthetic), the oil typically will contain 1 to 80, preferably from about 10 to 75, most preferably from about 10 to 50 weight percent synthetic lubricating oil. While the choice of the partial synthetic oil components may widely vary, particularly useful combinations are comprised of mineral oils and poly-α-olefins (PAO), particularly oligomers of 1-decene.

Amine Phosphates

The amine phosphates useful in this invention are the neutralization or partial neutralization products of acidic phosphorus-containing intermediates and amines. The acidic intermediates are preferably formed from a hydroxy-substituted triester of a phosphorothioic acid with an inorganic phosphorus reagent selected from the group consisting of phosphorus acids, phosphorus oxides, and phosphorus halides.

The hydroxy-substituted triesters of phosphorothioic acids useful in a preferred embodiment of this invention include principally those having the structural formula

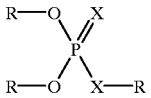

wherein R is selected from the class consisting of substantially hydrocarbon radicals and hydroxy-substituted substantially hydrocarbon radicals, at least one of the R radicals being a hydroxy-substituted substantially hydrocarbon radical, and X is selected from the class consisting of sulfur and oxygen, at least one of the X radicals being sulfur. The substantially hydrocarbon radicals include aromatic, aliphatic, and cycloaliphatic radicals such as aryl, alkyl, aralkyl, alkaryl, and cycloalkyl radicals. Such radicals may contain a polar substituent such as chloro, bromo, iodo, alkoxy, aryloxy, nitro, keto, or aldehydo group. In most instances there should be no more than one such polar group in a radical.

Specific examples of the substantially hydrocarbon radical are methyl, ethyl, isopropyl, secondary-butyl, isobutyl, n-pentyl, dodecyl, polyisobutene radical (molecular weight of 1500), cyclohexyl, cyclopentyl, 2-heptyl-cyclohexyl, phenyl, naphthyl, xenyl, p-heptylphenyl, 2,6di-tertiary-butylphenyl, benzyl, phenylethyl, 3,5-dodecylphenyl, chlorophenyl, alpha-methoxy-beta-naphthyl, p-nitrophenyl, p-phenoxyphenyl, 2-bromomethyl, 3-chlorocyclohexyl, and polypropylene (molecular weight of 300)-substituted phenyl radical.

The hydroxy-substituted substantially hydrocarbon radicals include principally the above-illustrated substantially hydrocarbon radicals containing a hydroxy group. Those having less than about 8 carbon atoms are preferred because of the convenience in preparing such hydroxy-substituted triesters. Examples of such radicals are hydroxymethyl, hydroxyethyl, 2-hydroxypropyl, 3-hydroxypropyl, 2-hydroxycyclohexyl, 2-hydroxycyclopentyl, 2-hydroxy-1-octyl, 1-hydroxy-3-octyl, 1-hydroxy-2-octyl, 2-hydroxy-3-phenyl-cyclohexyl, 1-hydroxy-2-phenylethyl, 2-hydroxy-1-phenylethyl, 2-hydroxy-1-p-tolylethyl, and 2hydroxy-3-butyl radicals. Other hydroxy-substituted substantially hydrocarbon radicals are exemplified by 2,5-dihydroxyphenyl, alpha-hydroxy-beta-naphthyl, 3-hydroxy4-dodecyl, 3-hydroxy-4-octadecyl, and p-(p-hydroxyphenyl)-phenyl radicals.

A preferred class of the hydroxy-substituted triesters comprises those having the structural formula

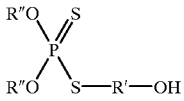

wherein R" is a substantially hydrocarbon radical illustrated above and R' is a bivalent substantially hydrocarbon radical such as alkylene or arylene radicals derived from the previously illustrated substantially hydrocarbon radicals. A convenient method for preparing such esters involves the reaction of a phosphorodithioic acid with an epoxide or a glycol. Such reaction is known in the art. The following equations are illustrative of the reaction.

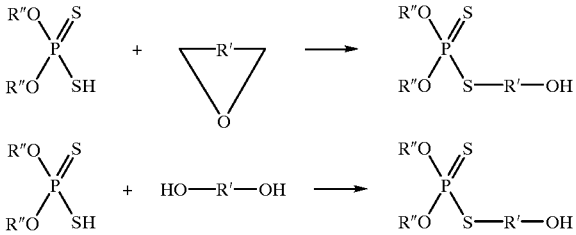

where

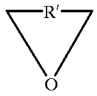

is an epoxide and HO—R'—OH is a glycol.

For reasons of economy aliphatic epoxides having less than about 8 carbon atoms and styrene oxides are preferred for use in the above process. Especially useful epoxides are exemplified by ethylene oxide, propylene oxide, styrene oxide, alpha-methylstyrene oxide, p-methylstyrene oxide, cyclohexene oxide, cyclopentene oxide, dodecene oxide, octadecene oxide, 2,3-butene oxide, 1,2-butene oxide, 1,2-octene oxide, 3,4-pentene oxide, and 4-phenyl-1,2-cyclohexene oxide. Glycols include both aliphatic and aromatic di-hydroxy compounds. The latter are exemplified by hydroquinone, catechol, resorcinol, and 1,2-dihydroxynaphthalene. Aliphatic glycols are especially useful such as ethylene glycol, trimethylene glycol, tetramethylene glycol, decamethylene glycol, di-ethylene glycol, triethylene glycol, and pentaethylene glycol.

Another convenient method for preparing the hydroxy-substituted triesters comprises the addition of a phosphorodithioic acid to an unsaturated alcohol such as allyl alcohol, cinnamyl alcohol, or oleyl alcohol such as is described in U.S. Pat. No. 2,528,723. Still another method involves the reaction of a metal phosphorothiate with a halogen-substituted alcohol described in U.S. Reissue Pat. No. 20,411.

The phosphorodithioic acids from which the hydroxy-substituted triesters can be derived are likewise well-known. They are prepared by the reaction of phosphorus pentasulfide with an alcohol or a phenol. The reaction involves 4 moles of the alcohol or phenol per mole of phosphorus pentasulfide and may be carried out within the temperature range from about 50° C. to about 200° C. Thus, the preparation of O,O'di-n-hexylphosphorodithioic acid involves the reaction of phosphorus pentasulfide with 4 moles of n-hexyl alcohol at about 100° C. for about 2 hours. Hydrogen sulfide is liberated and the residue is the defined acid. The preparation of the phosphoromonothioic acid may be effected by treatment of corresponding phosphorodithioic acid with steam. Phosphorotrithioic acids and phosphorotetrathioic acids can be obtained by the reaction of phosphorus pentasulfide with mercaptans or mixtures of mercaptans and alcohols.

The reaction of phosphorus pentasulfide with a mixture of phenols or alcohols (e.g., isobutanol and n-hexanol in 2:1 weight ratio) results in phosphorodithioic acids in which the two organic radicals are different. Such acids likewise are useful herein.

The inorganic phosphorus reagent useful in the reaction with the hydroxy-substituted triesters of phosphorothioic acids is preferably phosphorus pentoxide. Other phosphorus oxides such as phosphorus trioxide and phosphorus tetroxide likewise are useful. Also useful are phosphorus acids, and phosphorus halides. They are exemplified by phosphoric acid, pyrophosphoric acid, metaphosphoric acid, hypophosphoric acid, phosphorus acid, pyrophosphorous acid, metaphosphorous acid, hypophosphorous acid, phosphorous trichloride, phosphorus tribromide, phosphorous pentachloride, monobromophosphorus tetrachloride, phosphorus oxychloride, and phosphorus triiodide.

The reaction of the hydroxy-substituted triesters of phosphorothioic acids with the inorganic phosphorus reagent results in an acidic product. The chemical constitution of the acidic product depends to a large measure on the nature of the inorganic phosphorus reagent used. In most instances the product is a complex mixture the precise composition of which is not known. It is known, however, that the reaction involves the hydroxy radical of the triester with the inorganic phosphorus reagent. In this respect the reaction may be likened to that of an alcohol or a phenol with the inorganic phosphorus reagent. Thus, the reaction of the hydroxy-substituted triester with phosphorus pentoxide is believed to result principally in acidic phosphates, i.e., mono- or di-esters of phosphoric acid in which the ester radical is the residue obtained by the removal of the hydroxy radical of the phosphorothioic triester reactant. The product may also contain phosphonic acids and phosphinic acids in which one or two direct carbon-to-phosphorus linkages are present.

The acidic product of the reaction between the hydroxy-substituted triester with phosphorus oxyhalide or phosphoric acid is believed to result in similar mixtures of acidic phosphates, phosphonic acids, and/or phosphinic acids. On the other hand, the reaction of the hydroxy-substituted triester with phosphorus trichloride or phosphorus acid is believed to result principally in acidic organic phosphites. Still other products may be obtained from the use of other inorganic phosphorus reagents illustrated previously. In any event, the product is acidic and as such is useful as the intermediate for the preparation of the neutralized products of this invention.

Usually, from about 2 moles to about 5 moles of the triester is used for each mole of the inorganic phosphorus reagent. The preferred proportion of the triester is about 3–4 moles for each mole of the phosphorus reagent. The use of amounts of either reactant outside the limits indicated here results in excessive unused amounts of the reactant and is ordinarily not preferred.

The reaction of the hydroxy-substituted triester with the inorganic phosphorus reagent to produce the acidic intermediate can be effected simply by mixing the two reactant at a temperature above about room temperature, preferably above about 50° C. A higher temperature such as 100° C. or 150° C. may be used but ordinarily is unnecessary.

The amines useful for neutralizing the acidic intermediate may be aliphatic amines, aromatic amines, cycloaliphatic amines, heterocyclic amines, or carbocyclic amines. Amines having from about 4 to about 30 aliphatic carbon atoms ore preferred and aliphatic primary amines containing at least about 8 carbon atoms and having the formula, R"—$NH_2$, where R" is, for example, an aliphatic radical such as tert-octyl, tert-dodecyl, tert-tetradecyl, tert-octadecyl, cetyl, behenyl, stearyl, eicosyl, docosyl, tetracosyl, hexatriacontanyl, and pentahexacontanyl, are especially useful. Examples of other aliphatic amines include cyclohexyl amine, n-hexylamine, dodecylamine, di-dodecylamine, tridodecylamine, N-methyl-octylamine, butylamine, behenylamine, stearyl amine, oleyl amine, myristyl amine, and N-dodecyl trimethylene diamine, aniline, o-toluidine, benzidine, phenylene diamine, N,N'-di-sec-butylphenylene diamine, beta-naphthylamine, alpha-naphthylamine, morpholine, piperazine, menthane diamine, cyclopentyl amine, ethylene diamine, hexamethylene tetramine, octamethylene diamine, and N,N'-dibutyl-phenylene diamine Also useful are hydroxy-substituted amines such as ethanolamine, diethanolamine, triethanolamine, isopropanolamine, para-aminophenol, 4-amino-naphthol-1, 8-amino-naphthol-1, beta-aminoalizarin, 2-amino-2-ethyl-1,3-propandiol, 4-amino4'-hydroxy-diphenyl ether, 2-amino-resorcinol, etc.

Of the various available hydroxy-substituted amines which can be employed, a preference is expressed for hydroxy-substituted aliphatic amines, particularly those which conform for the most part to the formula

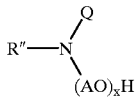

wherein R" is as previously defined; A is a lower alkylene radical such as methylene, ethylene, propylene-1,2, trimethylene, butylene-1,2, tetramethylene, amylene1,3, pentamethylene, etc.; x is 1–10, inclusive; and Q is hydrogen, $(AO)_xH$, or R". The use of such hydroxy-substituted aliphatic amines in many instances imparts improved rust-inhibiting characteristics to the phosphorus and nitrogen-containing compositions of this invention. Examples of such preferred hydroxy-substituted aliphatic amines include N-4-hydroxybutyl-dodecyl amine, N-2-hydroxyethyl-n-octylamine, N-2-hydroxypropyl dinonylamine, N,N-di-(3-hydroxypropyl)-tert-dodecyl amine, N-hydroxytrieth-oxyethyl-tert-tetradecyl amine, N-2-hydroxyethyl-tert-dodecyl amine, N-hydroxyhexa-propoxypropyl-tert-octadecyl amine, N-5-hydroxypentyl di-n-decyl amine, etc. A convenient and economical method for the preparation of such hydroxy-substituted aliphatic amines involves the known reaction of an aliphatic primary or secondary amine with at least about an equimolecular amount of an epoxide, preferably in the presence of a suitable catalyst such as sodium methoxide, sodamide, sodium metal, etc.

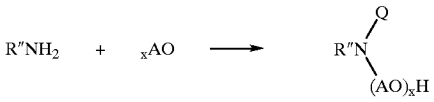

In the above formulas, R", x and A are as previously defined. A particular preference is expressed for N-monohydroxyalkyl substituted mono-tertiary-alkyl amines of the formula tert-R—NHAOH, wherein tert-R is a tertiary-alkyl radical containing from about 11 to about 24 carbon atoms. In lieu of a single compound of the formula tert-R—NHAOH, it is often convenient and desirable to use a mixture of such compounds prepared, for example, by the reaction of an epoxide such as ethylene oxide, propylene oxide, or butylene oxide with a commercial mixture of tertiary-alkyl primary amines such as $C_{11-C14}$ tertiary-alkyl primary amines, $C_{13}$–$C_{22}$ tertiary-alkyl primary amines, etc.

The neutralization of the acidic intermediate with the amine is in most instances exothermic and can be carried out simply by mixing the reactants at ordinary temperatures, preferably from about 0° C. to about 200° C. The chemical constitution of the neutralized product of the reaction depends to a large extent upon the temperature. Thus, at a relatively low temperature, such as less than about 80° C., the product comprises predominantly a salt of the amine with the acid. At a temperature above 100° C., the product may contain amides, amidines, or mixtures thereof. However, the reaction of the acidic intermediate with a tertiary amine results only in a salt.

The relative proportions of the acidic intermediate and the amines used in the reaction are preferably such that a substantial portion of the acidic intermediate is neutralized The lower limit as to the amount of amine used in the reaction is based primarily upon a considerable of the utility of the product formed. In most instances, enough amine should be sued as to neutralize at least about 50% of the acidity of the intermediate. For use as additives in hydrocarbon oils, substantially neutral products such as are obtained by neutralization of at least about 90% of the acidity of the intermediate are desirable, whereas for use as insecticides or rust-preventive agents for treatment of metals, products obtained by neutralizing as little as bout 50% of the acidity of the intermediate are effective. Thus the amount of the amine used may vary within wide ranges depending upon the acidity desired in the product and also upon the acidity of the intermediate as determined by, for example, ASTM procedure designation D-664 or D-974.

While any effective amount of the amine phosphate may be used, typically the amine phosphate will be present in a finished CVT fluid in an amount from 0.01 to 5, preferably from 0.05 to 4, most preferably from 0.1 to 3 weight percent.

Organic Polysulfides

Materials useful as this component are aliphatic and cycloaliphatic hydrocarbon polysulfides.

Characteristic of the organic polysulfides are sulfur atoms which are bonded only by secondary valence bonds, such sulfur is more readily given up by the molecule,, i.e., is more reactive chemically, than sulfur which is bonded to a carbon atom of an organic radical. The very fact that such sulfur is chemically reactive facilitates its determination. For example, a test sample of the organic polysulfide may be treated with reagents which are known to react with and thus to remove reactive sulfur such as, e.g., warm aqueous caustic solutions, warm aqueous solutions of metallic monosulfides, finely divided metals such as copper, lead, iron, silver, etc. The loss in sulfur content of the test sample of organic polysulfide after such treatment corresponds to the amount of reactive sulfur originally present, i.e., that sulfur which is bonded only by secondary valence bonds.

The following partial structures illustrate some of the many arrangements which sulfur atoms can assume in organic polysulfides:

Disulfides:

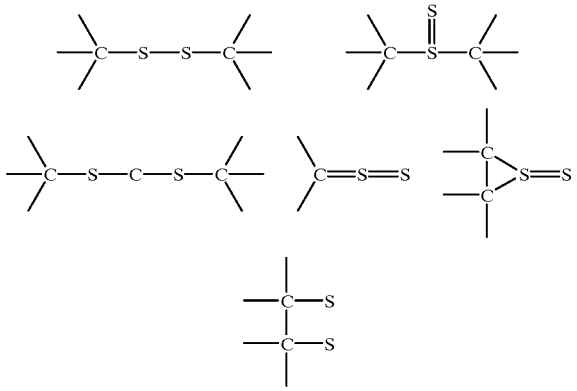

Trisulfides:

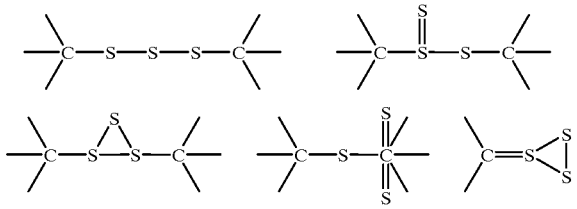

-continued

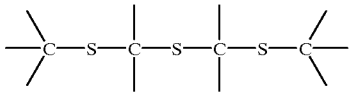

Higher polysulfides:

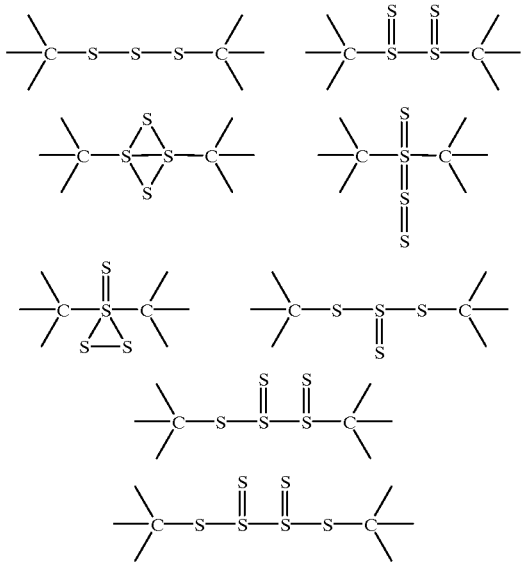

From a study of the structures given above, it will be apparent that organic polysulfides of like molecular weight and containing the same percentages of chemical elements may possess widely different amounts of reactive sulfur depending on the mode of attachment of the sulfur atoms within the molecule. Those structures which possess the largest number of sulfur atoms bonded only by secondary valence bonds will possess the highest percentage of reactive sulfur.

Specific examples of organic polysulfides which contain at least one sulfur atom bonded only by secondary valence bonds and which are useful in this invention are: diisobutyl trisulfide; diisoamyl trisulfide; di-n-butyl tetrasulfide; dicyclopentyl disulfide; di-methyl cyclohexyl tetrasulfide; di-ethyl cyclopentyl disulfide; dipentene trisulfide; and beta-pinene pentasulfide The preparation of the organic polysulfides may be accomplished by any of the many different processes which are known and disclosed in the art including, for example, the reaction of halogen-bearing organic compounds with alkali metal polysulfides, the reaction of mercaptans with sulfur and/or sulfur halides, the reaction of saturated and unsaturated hydrocarbons with sulfur and/or sulfur halides, the reaction of organic monosulfides with sulfur, etc. Thus a particularly suitable polysulfide may be prepared by adding 11.3 moles of isobutylene to 6.3 moles of sulfur monochloride while the temperature of the exothermic reaction is maintained at about 115° F. To 14 parts of this sulfochlorinated isobutylene there was added 38.5 parts of a 22% aqueous solution of sodium sulfide. It was necessary to cool the reaction mixture to keep the temperature below 130° F. and when all of the sodium sulfide had been added the reaction mixture then was heated at reflux temperature for 6 hours. The organic layer was dried and filtered to yield a product suitable for use in this invention.

While any effective amount of the organic polysulfides may be used, typically the organic polysulfide will be present in a finished CVT fluid in an amount from 0.01 to 10 preferably from 0.05 to 7, most preferably 0.1 to 5 weight percent.

Zinc Salts of Phosphorothioic Acid Esters

The components of this type may be defined as zinc salts of phosphorodithioic acids having the structure

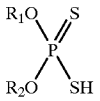

in which $R_1$ and $R_2$ are alkyl radicals each containing from 1 to about 40 carbon atoms. These alkyl radicals may be straight chain or branched, and they may be alike or dissimilar. Thus the zinc salt may be the zinc salt of a simple di-ester, i.e., one in which the alkyl radicals are alike; or it may be the zinc salt of a mixed di-ester, i.e., one in which the alkyl radicals are dissimilar, it may also be the zinc salt of a mixture of different simple di-esters, e.g., the zinc salt of a mixture of di-isopropyl phosphorodithioic acid and di-n-hexyl phosphorodithioic acid; or it may be the zinc salt of a mixture of a simple di-ester and a mixed di-ester; and lastly it may be the zinc salt of a mixture of mixed di-esters.

The character of $R_1$ and $R_2$ in the structural formula is illustrated by the following examples: methyl, ethyl, n-propyl, isobutyl, n-amyl, tert-amyl, 2-methyl, pentyl-4, 2-ethyl hexyl, n-octyl, nonyl, decyl, dodecyl, tetradecyl, octadecyl, eicosyl, tricosyl, and others having up to about 40 carbon atoms.

A particularly preferred species is the zinc salt of a di-alkyl ester of a phosphorodithioic acid having the previously illustrated structure in which $R_1$ contains at least six carbon atoms and $R_2$ contains less than six carbon atoms. Another preferred species for use as component A is the zinc salt of a mixture of different di-alkyl esters of a phosphorodithioic acid, one of said di-alkyl esters containing only radicals having less than six carbon atoms and another of said di-alkyl esters containing only radicals having at least six carbon atoms. In each of these preferred species an especially valuable subspecies is one in which the lower molecular weight alkyl group is the isopropyl radical and in which the higher molecular weight alkyl group is the 2-methyl-pentyl-4 radical. These particular species and subspecies are disclosed in U.S. Pat. No. 2,838,555.

Other species examples of compounds which are useful include zinc salts of: di-n-hexyl phosphorodithioic acid; di-n-octyl phosphorodithioic acid; di-dodecyl phosphorodithioic acid; ethyl octyl phosphorodithioic acid; n-propyl octyl phosphorodithioic acid; isobutyl decyl phosphorodithioic acid; isoamyl n-hexyl phosphorodithioic acid and methyl octadecyl phosphorodithioic acid.

The preparation of the phosphorodithioic acids from which the zinc salts may be prepared are readily available by the well known process involving the reaction of an alcohol with phosphorus pentasulfide.

While any effective amount of the zinc salt of the phosphorothioic acid ester may be used, typically the zinc salt will be present in a finished CVT fluid in an amount from 0.01 to 3, preferably from 0.05 to 2, most preferably from 0.1 to 1.5 weight percent.

Friction Modifiers

A wide variety of friction modifiers may be employed in the present invention including the following:

(i) Alkoxylated Amines

Alkoxylated amines are a particularly suitable type of friction modifier for use in this invention. These types of friction modifiers may be selected from the group consisting of (I), (II), and mixtures thereof, where (I) and (II) are:

(I)

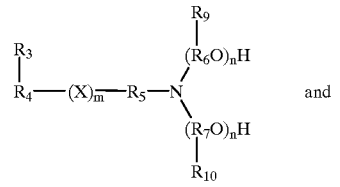

and (II)

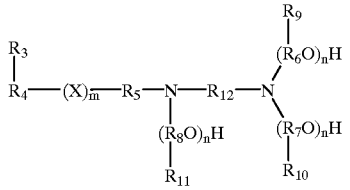

where:

$R_3$ is H or $CH_3$;

$R_4$ is a $C_8$–$C_{28}$ saturated or unsaturated, substituted or unsubstituted, aliphatic hydrocarbyl radical, preferably $C_{10}$–$C_{20}$, most preferably $C_{14}$–$C_{18}$;

$R_5$ is a straight or branched chain $C_1$–$C_6$ alkylene radical, preferably $C_2$–$C_3$;

$R_6$, $R_7$, and $R_8$ are independently the same or different, straight or branched chain $C_2$–$C_5$ alkylene radical, preferably $C_2$–$C_4$;

$R_9$, $R_{10}$, and $R_{11}$ are independently H or $CH_3$;

$R_{12}$ is a straight or branched chain $C_1$–$C_5$ alkylene radical, preferably $C_2$–$C_3$;

X is oxygen or sulfur, preferably oxygen; m is 0 or 1, preferably 1; and n is an integer, independently 1–4, preferably 1.

In a particularly preferred embodiment, this type of friction modifier is characterized by formula (I) where X represents oxygen, $R_3$ and $R_4$ contain a combined total of 18 carbon atoms, $R_5$ represents a $C_3$ alkylene radical, $R_6$ and $R_7$ represent $C_2$ alkylene radicals, $R_9$ and $R_{10}$ are hydrogens, m is 1, and each n is 1. Preferred amine compounds contain a combined total of from about 18 to about 30 carbon atoms.

Preparation of the amine compounds, when X is oxygen and m is 1, is, for example, by a multi-step process where an alkanol is first reacted, in the presence of a catalyst, with an unsaturated nitrile such as acrylonitrile to form an ether nitrile intermediate. The intermediate is then hydrogenated, preferably in the presence of a conventional hydrogenation catalyst, such as platinum black or Raney nickel, to form an ether amine. The ether amine is then reacted with an alkylene oxide, such as ethylene oxide, in the presence of an alkaline catalyst by a conventional method at a temperature in the range of about 90–150° C.

Another method of preparing the amine compounds, when X is oxygen and m is 1, is to react a fatty acid with ammonia or an alkanol amine, such as ethanolamine, to form an intermediate which can be further oxyalkylated by reaction with an alkylene oxide, such as ethylene oxide or propylene oxide. A process of this type is discussed in, for example, U.S. Pat. No. 4,201,684.

When X is sulfur and m is 1, the amine friction modifying compounds can be formed, for example, by effecting a conventional free radical reaction between a long chain alpha-olefin with a hydroxyalkyl mercaptan, such as beta-hydroxyethyl mercaptan, to produce a long chain alkyl hydroxyalkyl sulfide. The long chain alkyl hydroxyalkyl sulfide is then mixed with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discussed in, for example, U.S. Pat. No. 3,705,139.

In cases when X is oxygen and m is 1, the present amine friction modifiers are well known in the art and are described in, for example, U.S. Pat. Nos. 3,186,946, 4,170,560, 4,231,883, 4,409,000 and 3,711,406.

Examples of suitable amine compounds include, but are not limited to, the following:

N,N-bis(2-hydroxyethyl)-n-dodecylamine;
N,N-bis(2-hydroxyethyl)-1-methyl-tridecenylamine;
N,N-bis(2-hydroxyethyl)-hexadecylamine;
N,N-bis(2-hydroxyethyl)-octadecylamine;
N,N-bis(2-hydroxyethyl)-octadecenylamine;
N,N-bis(2-hydroxyethyl)-oleylamine;
N,N-bis(2-hydroxyethyl)-stearylamine;
N,N-bis(2-hydroxyethyl)-undecylamine;
N-(2-hydroxyethyl)-N-(hydroxyethoxyethyl)-n-dodecylamine;
N,N-bis(2-hydroxyethyl)-1-methyl-undecylamine;
N,N-bis(2-hydroxyethoxyethoxyethyl)-1-ethyl-octadecylamine;
N,N-bis(2-hydroxyethyl)-cocoamine;
N,N-bis(2-hydroxyethyl)-tallowamine;
N,N-bis(2-hydroxyethyl)-n-dodecyloxyethylamine;
N,N-bis(2-hydroxyethyl)-lauryloxyethylamine;
N,N-bis(2-hydroxyethyl)-stearyloxyethylamine;
N,N-bis(2-hydroxyethyl)-dodecylthioethylamine;
N,N-bis(2-hydroxyethyl)-dodecylthiopropylamine;
N,N-bis(2-hydroxyethyl)-hexadecyloxypropylamine;
N,N-bis(2-hydroxyethyl)-hexadecylthiopropylamine;
N-2-hydroxyethyl,N-[N',N'-bis(2hydroxyethyl) ethylamine]-octadecylamine; and
N-2-hydroxyethyl,N-[N',N'-bis(2-hydroxyethyl) ethylamine]-stearylamine.

The most preferred additive is N,N-bis(2-hydroxyethyl)-hexadecyloxypropylamine. This additive is available from Tomah Company under the designation Tomah E-22-S-2.

The amine's hydrocarbyl chain length, the saturation of the hydrocarbyl chain, and the length and position of the polyoxyalkylene chains can be varied to suit specific requirements. For example, increasing the number of carbon atoms in the hydrocarbyl radical tends to increase the amine's melting temperature and oil solubility, however, if the hydrocarbyl radical is too long, the amine will crystallize from solution. Decreasing the degree of saturation in the hydrocarbyl radical, at the same carbon content of the hydrocarbyl chain, tends to reduce the melting point of the amine. Increasing the amount of alkylene oxide, to lengthen the polyoxyalkylene chains, tends to increase the amine's water solubility and decrease its oil solubility.

The amine compounds may be used as such. However, they may also be used in the form of an adduct or reaction product with a boron compound, such as a boric oxide, a boron halide, a metaborate, boric acid, or a mono-, di-, and trialkyl borate. Such adducts or derivatives may be illustrated, for example, by the following structural formula:

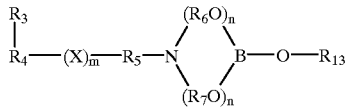

where $R_3$, $R_4$, $R_5$, $R_6$, $R_7$, X, m, and n are the same as previously defined and where $R_{13}$ is either hydrogen or an alkyl radical.

(ii) Carboxylic Acids/Anhydrides with Polyamines

A second type of friction modifier useful with this invention is the reaction product of a polyamine and a carboxylic acid or anhydride and metal salts thereof. Briefly, the polyamine reactant contains from 2 to 60 total carbon atoms. and from 3 to 15 nitrogen atoms with at least one of the nitrogen atoms present in the form of a primary amine group and at least two of the remaining nitrogen atoms present in the form of primary or secondary amine groups. Non-limiting examples of suitable amine compounds include: polyethylene amines such as diethylene triamine (DETA); triethylene tetramine (TETA); tetraethylene pentamine (TEPA); polypropylene amines such as di-(1,2-propylene) triamine, di(1,3-propylene) triamine, and mixtures thereof. Additional suitable amines include polyoxyalkylene polyamines such as polyoxypropylene triamines and polyoxyethylene triamines. Preferred amines include DETA, TETA, TEPA, and mixtures thereof (PAM). The most preferred amines are TETA, TEPA, and PAM.

The carboxylic acid or anhydride reactant of the above reaction product is characterized by formula (III), (IV), (V), (VI), and mixtures thereof:

(III)

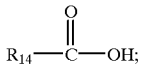

(IV)

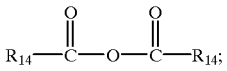

(V)

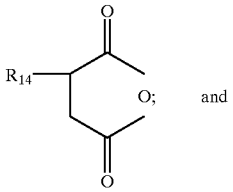

(VI)

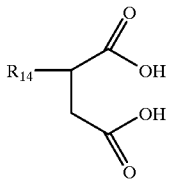

where $R_{14}$ is a straight or branched chain, saturated or unsaturated, aliphatic hydrocarbyl radical containing from 9 to 29 carbon atoms, preferably from 11 to 23. When $R_{14}$ is a branched chain group, no more than 25% of the carbon atoms are in side chain or pendent groups. $R_{14}$ is preferably straight chained.

The $R_{14}$ hydrocarbyl group includes predominantly hydrocarbyl groups as well as purely hydrocarbyl groups. The description of these groups as predominantly hydrocarbyl means that they contain no non-hydrocarbyl substituents or non-carbon atoms that significantly affect the hydrocarbyl characteristics or properties of such groups relevant to their uses as described here. For example, a purely hydrocarbyl $C_{20}$ alkyl group and a $C_{20}$ alkyl group substituted with a methoxy substituent are substantially similar in their properties and would be considered hydrocarbyl within the context of this disclosure.

Non-limiting examples of substituents that do not significantly alter the hydrocarbyl characteristics or properties of the general nature of the hydrocarbyl groups of the carboxylic acid or anhydride are:

Ether groups (especially hydrocarbyloxy such as phenoxy, benzyloxy, methoxy, n-isotoxy, etc., particularly alkoxy groups of up to ten carbon atoms);

Oxo groups (e.g., —O—linkages in the main carbon chain);

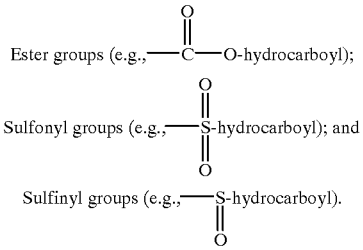

These types of friction modifiers can be formed by reacting, at a temperature from about 120 to 250° C., at least one polyamine and one carboxylic acid or anhydride in proportions of about 2 to 10 molar equivalents of carboxylic acid or anhydride per mole of amine reactant.

(iii) Other Friction Modifiers

Optionally, other friction modifiers may be used either alone or in combination with the foregoing described friction modifiers to achieve the desired fluid performance. Among these are esters of carboxylic acids and anhydrides with alkanols. Other conventional friction modifiers generally consist of a polar terminal group (carboxyl, hydroxyl, amino, etc.) covalently bonded to an oleophilic hydrocarbon chain.

Particularly preferred esters of carboxylic acids and anhydrides with alkanols are described in, for example, U.S. Pat. No. 4,702,850. This reference teaches the usefulness of these esters as friction modifiers, particularly the esters of succinic acids or anhydrides with thio-bis-alkanols, most particularly with esters of 2-octadecenyl succinic anhydride and thiodiglycol.

The optional polyolester friction modifiers of this invention are the esters of polyalcohols with long chain fatty acids. Particularly preferred are triol esters of fatty acids. These materials have the structures shown as (VII), (VIII), and (IX) where (VII), (VIII), and (IX) are represented by:

(VII)

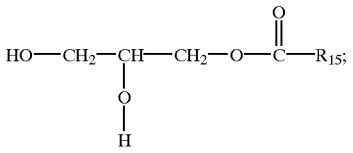

-continued (VIII)

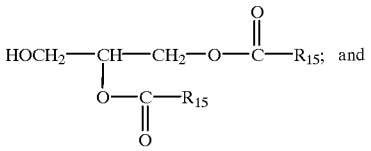

(IX)

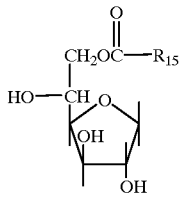

where:

$R_{15}$ is aliphatic hydrocarbyl, including straight chain, saturated or unsaturated hydrocarbyl group, typically aliphatic having from about 9 to about 29, preferably from about 11 to about 23 and most preferably from about 15 to about 20 carbon atoms. The term 'hydrocarbyl' is used herein to include substantially hydrocarbyl groups, as well as purely hydrocarbyl groups. The description of these groups as being substantially hydrocarbyl means that they contain no non-hydrocarbyl substituents or non-carbon atoms which significantly affect the hydrocarbyl properties relative to the description herein.

Representative examples of suitable fatty acids include nonanoic (pelargonic); decanoic (capric); undecanoic; dodecanoic (lauric); tridecanoic; tetradecanoic (myristic); pentadecanoic; hexadecanoic (palmytic); heptadecanoic (margaric); octadecanoic (stearic or iso-stearic); nonadecanoic; eicosic (arachidic); decenoic; undecenoic; dodecenoic; tridecenoic; pentadecenoic; hexadecenoic; heptadecenoic; octadecenoic (oleic); eicosenoic or mixtures thereof.

Examples of suitable polyol esters useful in this invention are: glycerol mono-oleate, glycerol dioleate, glycerol mono-isostearate, tri-glycerol di-isostearate, sorbitan mono-oleate, sorbitan sesquioleate, sorbitan trioleate, sorbitan stearate, sorbitan palmitate. The preferred polyol ester type friction modifiers for use in this invention are glycerol mono-oleate and glycerol dioleate, and mixtures thereof. Metal salts of these are also suitable particularly when the metal is copper.

Examples of other conventional friction modifiers (i.e., polar terminal group+oleophilic hydrocarbon chain) are described by, for example, M. Belzer in the "Journal of Tribology" (1992), Vol. 114, pp. 675–682 and M. Belzer and S. Jahanmir in "Lubrication Science" (1988), Vol. 1, pp. 3–26.

Typically the friction modifiers will be present in a finished CVT composition in an amount from 0.01 to 5, preferably from 0.05 to 3, most preferably from 0.05 to 1.5 weight percent.

Other additives known in the art may be added to the CVT. These additives include dispersants, antiwear agents, antioxidants, corrosion inhibitors, metallic detergents, extreme pressure additives, and the like. They are generally disclosed in, for example, "Lubricant Additives" by C. V. Smalheer and R. Kennedy Smith, 1967, pp. 1–11 and U.S. Pat. Nos. 5,389,273; 5,326,487; 5,314,633; 5,256,324; 5,242,612; 5,198,133; 5,185,090; 5,164,103; 4,855,074; and 4,105,571.

Representative amounts of these additives in a fully formulated CVT fluid are summarized as follows:

| Additive | (Broad) Wt. % | (Preferred) Wt. % |
|---|---|---|
| VI Improvers | 0–12 | 1–4 |
| Corrosion Inhibitor | 0.01–3 | 0.02–1 |
| Dispersants | 0.10–10 | 2–5 |
| Antifoaming Agents | 0–5 | 0.001–0.5 |
| Metallic Detergents | 0–6 | 0.01–3 |
| Antiwear Agents | 0.001–5 | 0.2–3 |
| Pour Point Depressants | 0.00–2 | 0.01–1.5 |
| Seal Swellants | 0.1–8 | 0.5–5 |
| Lubricating Oil | Balance | Balance |

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Mixtures of such dispersants can also be used.

The preferred dispersants are the alkenyl succinimides. These include acyclic hydrocarbyl substituted succinimides formed with various amines or amine derivatives such as are widely disclosed in the patent literature. Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art. (see, e.g., U.S. Pat Nos. 3,254,025, 3,502,677 and 4,857,214).

The metal-containing detergents useful in this invention are exemplified by oil-soluble neutral or overbased salts of alkali or alkaline earth metals with one or more of the following acidic substances (or mixtures thereof): (1) sulfonic acids, (2) carboxylic acids, (3) salicylic acids, (4) alkyl phenols, (5) sulfurized alkyl phenols, (6) organic phosphorus acids characterized by at least one direct carbon-to-phosphorus linkage. Such organic phosphorus acids include those prepared by the treatment of an olefin polymer (e.g., polyisobutylene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The preferred salts of such acids from the cost-effectiveness, toxicological, and environmental standpoints are the salts of sodium, potassium, lithium, calcium and magnesium. The preferred salts useful with this invention are either neutral or overbased salts of calcium or magnesium.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discverbased salts of such substances as lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates wherein each aromatic group has one or more aliphatic groups to impart hydrocarbon solubility; lithium sulfonates, sodium sulfonates, potassium sulfonates, calcium sulfonates, and magnesium sulfonates wherein each sulfonic acid moiety is attached to an aromatic nucleus which in turn usually contains one or more aliphatic substituents to impart hydrocarbon solubility; lithium salicylates, sodium salicylates, potassium salicylates, calcium salicylates and magnesium salicylates wherein the aromatic moiety is usually substituted by one or more aliphatic substituents to impart hydrocarbon solubility; the lithium, sodium, potassium, calcium and magnesium salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; lithium, sodium, potassium, calcium and magnesium salts of aliphatic carboxylic acids and aliphatic substituted cycloaliphatic carboxylic acids; and many other similar alkali and alkaline earth metal salts of oil-soluble organic acids. Mixtures of neutral or over-based salts of two or more different alkali and/or alkaline earth metals can be used. Likewise, neutral and/or overbased salts of mixtures of two or more different acids (e.g. one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Collectively, the various metallic detergents referred to herein above, have sometimes been called, simply, neutral, basic or overbased alkali metal or alkaline earth metal-containing organic acid salts.

Methods for the production of oil-soluble neutral and overbased metallic detergents and alkaline earth metal-containing detergents are well known to those skilled in the art, and extensively reported in the patent literature. See for example, the disclosures of U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; 4,880,550.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; 4,965,004.

Preferred metallic detergents for use with this invention are neutral and overbased calcium or magnesium sulphurised phenates, and neutral and overbased calcium or magnesium sulphonates.

The additive combinations of this invention may be combined with other desired lubricating oil additives to form a concentrate Typically the active ingredient (a.i.) level of the concentrate will range from 30 to 100, preferably 40 to 95, most preferably 50 to 95 weight percent of the concentrate. The balance of the concentrate is a diluent typically comprised of a lubricating oil or solvent.

The following examples are given as specific illustrations of the claimed invention. It should be understood, however, that the invention is not limited to the specific details set forth in the examples. All parts and percentages are by weight unless otherwise specified.

EXAMPLES

The following data demonstrate the load carrying/extreme pressure antiwear characteristics of this invention and their compatibility in formulations containing conventional friction modifiers used in power transmission fluids.

The methods used to test the load carrying/extreme pressure antiwear characteristics were according to the well-known and widely accepted Timken (IP 239/85 (1992) and the Four-ball Machine (IP 240/84 (1992) or ASTM D2782-88) methods. Briefly, the Timken method tests the maximum load or pressure that can be sustained by a fluid without failure of the sliding contact surfaces as evidenced by scoring or seizure (localized fusion of metal). The Four-ball method measures the initial seizure load (ISL) (indicated by an increase in friction and wear) and weld point (occurs when fusion of metal between the metal balls is sufficient to weld the four balls together).

Achieving Timken values no less than 18 kilograms (kg) (40 lbs) and Four-ball values of no less than 130 kg for the ISL and no less than 240 kg for the weld point are desirable to achieve the exacting load carrying/extreme pressure characteristics of this invention.

A base fluid was prepared comprising a synthetic poly-alpha-olefin base stock combination (approximately 20 wt % PAO6 (kinematic viscosity ≈6 $mm^2/s$ at 100° C.) and approximately 75 wt % PAO8 (kinematic viscosity ≈8 $mm^2/s$ at 100° C.)) with conventional amounts of succinimide dispersant, diphenylamine antioxidant, thiadiazole corrosion inhibitor, calcium sulfonate detergent, and polydimethylsiloxane antifoamant. Into seven (7) samples of the base fluid were placed the following combinations of additives identified as Blends 1 to 7 in Table 1.

From Table 1 it can be seen that only in Blends 4 to 7 (which contain this invention's additive combination of an amine phosphate, organic polysulfide, and a zinc salt of a dithiophosphorotioic acid) are the load-carrying/extreme pressure antiwear requirements of the invention satified (i.e., Timken≧18 kg; Four-ball ISL≧130 kg; and Four-ball weld point≧240 kg) In contrast, Blends 1 to 4 which do not contain the additive combinations of this invention, fail to meet these performance characteristics. Such failing values are indicated by the shaded values. Finally, the data of Table 1 show that conventional friction modifiers such as the acid ester used in these blends are compatible with the additive combinations of this invention.

The principles, preferred embodiments, and modes of operation of the present invention have been described in the foregoing specification. However, the invention which is intended to be protected herein is not to be construed as limited to the particular forms disclosed, since these are to be regarded as illustrative rather than restrictive. Variations and changes may be made by those skilled in the art without departing from the spirit of the invention.

TABLE 1

| | BLENDS: | | | | | | |
|---|---|---|---|---|---|---|---|
| Components | 1 | 2 | 3 | 4 | 5 | 6 | 7 |
| Amine Phosphate[1] | — | — | 1.0 | 1.0 | 1.0 | 1.0 | 1.0 |
| Sulfurized Isobutylene | — | — | — | 1.0 | 1.0 | 1.0 | 1.0 |
| ZDDP[2] | 1.2 | 1.2 | 1.2 | 1.2 | 1.2 | 1.2 | 2.4 |
| Friction Modifier[3] | 0.5 | 0.5 | 0.5 | 0.5 | 1.0 | 0.5 | 0.5 |
| Results: | FAIL | FAIL | FAIL | PASS | PASS | PASS | PASS |
| Timken (kg) | 12.2 | 22.7 | 15.0 | 18.2 | 20.4 | 20.4 | 18.2 |
| Four-Ball ISL (kg) | 133 | 115 | 120 | 135 | 148 | 145 | 153 |
| Four-Ball Weld Point (kg) | 165 | 265 | 215 | 255 | 240 | 245 | 255 |

Notes:
(1) Partial neutralisation product of $C_{12}$–$C_{14}$ tertiary primary aliphatic amine and the reaction product of $P_2O_5$ and 0,0-di(4-methyl-2-pentyl) phosphorodithioate.
(2) Zinc salt of (isooctyl-2-butanyl) dithiophosphorothioic acid ester.
(3) Ester of 2-octadecenyl succinic anhydride and thiodiglycol.

What is claimed is:

1. A method of improving the antiwear and friction performance of a continuously variable transmission fluid comprising a major amount of lubricating oil by incorporating into the fluid an antiwear improving effective amount of an additive combination consisting essentially of:

(a) an amine phosphate which is a neutralization or partial neutralization product of an aliphatic primary amine and a hydroxy-substituted triester of a phosphorothioic acid treated with an inorganic phosphorus reagent, where the triester is prepared (i) by reaction of a phosphorothioic acid with an aliphatic epoxide having less than 8 carbon atoms, styrene oxide a glycol, or an unsaturated alcohol or (ii) by the reaction of a metal phosphorothioate with a halogen-substituted alcohol;

(b) a sulfurized polyisobutylene;

(c) a zinc salt of a phosphorothioic acid ester; and (d) a friction modifier.

2. The method of claim 1 where the lubricating oil is a mineral oil, poly-α-olefin, or mixtures thereof.

3. The method of claims 1 or 2 where the friction modifier is a full or partial alcoholic ester of a mono or polycarboxylic acid.

* * * * *